US011274550B2

(12) United States Patent
Duncan et al.

(10) Patent No.: US 11,274,550 B2
(45) Date of Patent: Mar. 15, 2022

(54) WELL TEST MODULE

(71) Applicant: FMC Technologies, Inc., Houston, TX (US)

(72) Inventors: Iain Duncan, Houston, TX (US); Wade Wells, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 16/923,544

(22) Filed: Jul. 8, 2020

(65) Prior Publication Data

US 2022/0010677 A1 Jan. 13, 2022

(51) Int. Cl.

| | |
|---|---|
| ***E21B 49/08*** | (2006.01) |
| ***E21B 43/12*** | (2006.01) |
| ***E21B 34/16*** | (2006.01) |
| ***E21B 47/117*** | (2012.01) |

(52) U.S. Cl.

CPC ..... *E21B 49/088* (2013.01); *E21B 34/16* (2013.01); *E21B 43/12* (2013.01); *E21B 49/086* (2013.01); *E21B 47/117* (2020.05)

(58) Field of Classification Search

CPC ..... E21B 49/088; E21B 49/086; E21B 34/16; E21B 43/12; E21B 47/117

See application file for complete search history.

(56) References Cited

U.S. PATENT DOCUMENTS

| | | | | |
|---|---|---|---|---|
| 2,800,138 | A * | 7/1957 | Peters | F16K 31/128 137/122 |
| 5,050,438 | A * | 9/1991 | Ezell, Jr. | G01F 15/028 73/861 |
| 7,137,451 | B2 * | 11/2006 | Smith | E21B 33/0355 166/335 |
| 2004/0144543 | A1 | 7/2004 | Appleford et al. | |
| 2015/0226051 | A1 * | 8/2015 | Machado | E21B 49/08 166/250.03 |
| 2017/0010139 | A1 * | 1/2017 | Vilstrup | E21B 43/12 |

FOREIGN PATENT DOCUMENTS

| | | | |
|---|---|---|---|
| WO | 2018004714 | A1 | 1/2018 |

OTHER PUBLICATIONS

International Search Report issued in International Application No. PCT/US2021/040829 dated Oct. 20, 2021 (4 pages).

(Continued)

*Primary Examiner* — James G Sayre

(74) *Attorney, Agent, or Firm* — Osha Bergman Watanabe & Burton LLP

(57) ABSTRACT

A well test module is disclosed including a production manifold, a well test manifold, and a plurality of diverter valves, each having an input port coupled to a well inlet, a first output port coupled to the production manifold by a production loop, and a second output port coupled to the well test manifold. The well test module also includes a first flow meter having an input port coupled to a first end of the well test manifold and an output port coupled to the production manifold by a first well test flow line and a second flow meter having an input port coupled to a second end of the well test manifold and an output port coupled to the production manifold by a second well test flow line.

20 Claims, 4 Drawing Sheets

(56) References Cited

OTHER PUBLICATIONS

Written Opinion issued in International Application No. PCT/US2021/040829 dated Oct. 20, 2021 (6 pages).
METIS Africa SKIDM: "SKIDM presentation English" Jan. 22, 2020, pp. 1-4, XP054982346, Retrieved from the ntemet: URL:https://www.youtube.com/watch?v=jF82pKB74pk [retrieved on Oct. 11, 2021] Minute 0:39, Minute 0:49, Minute 1:11, Minute 1:20, Minute 1:23 (4 pages).
Sequeira, Daniel "Using Multi-Phase Flow Meters for Well Testoptimization in the new Digital yet CostSensitive Environment" No. XP055850087, Apr. 1, 2020, pp. 1-19, XP55850087, Retrieved from the Internet: URL:https://vww.spegcs.org/media/files/files/d6f346c8/spe-northside-apr-14-webinar.pdf [retrieved on Oct. 11, 2021] p. 12 (19 pages).

* cited by examiner

WELL TEST MODULE

TECHNICAL FIELD

The present disclosed subject matter generally relates to the field of oil and gas well production and, in one particular example, to a well test module.

BACKGROUND

For many onshore or offshore developments, it is useful to monitor the output of production wells to measure operational efficiency. In general, tests are performed to determine what each well is actually producing, whether it is an oil or gas producer. As the operator strives to maximize the production output of an onshore or offshore development, there are a number of reservoir-related issues that can arise and dramatically reduce the quality of each well's output. Therefore, production well testing is of paramount importance for building a reliable and accurate picture of a development's reservoir and the capabilities of the production wells. Operating companies require periodic testing to determine well production performance, flowing pressures, fluid properties, and to monitor the characteristics of the reservoir. The main objectives of these tests are to provide feedback to the reservoir engineers on the success of the completion design and the active depletion of the reservoir. This information is critical to the reservoir department and allows the company to optimize its production and secure the life of the development.

Early testing and information gathering enables the reservoir engineers to confirm their models and make adjustments to the development plan to meet the production goals of the company, which may include an early intervention plan to correct anomalies. Typically, every field may be different, with the production being naturally driven or artificially lifted. In each case, there are contaminants entering the production flow, such as gases, water or other contaminants. Field operators need to know what each well is producing to correctly manage the optimal depletion of the reservoir.

The typical systems employed for testing both onshore and offshore installations include a well test separator that is utilized to measure the phased flow and compile the produced phased output flow characteristic, along with pressure and temperature data. Such well testing systems often require installations with large footprints to handle the separator and the routing of outputs from various fields to the testing equipment. Such installations commonly require operators to make and break connections in the field and to maintain a personnel presence at the site. These traditional methods of production well testing limit access to real-time data, and subsequently result in delays in the process of making a meaningful determination on the condition of the well and the dynamics of the reservoir, leading to slow responses for correcting well anomalies and optimizing performance.

The present application is directed to a well test module that may eliminate or at least minimize some of the problems noted above.

SUMMARY

The following presents a simplified summary of the subject matter disclosed herein in order to provide a basic understanding of some aspects of the information set forth herein. This summary is not an exhaustive overview of the disclosed subject matter. It is not intended to identify key or critical elements of the disclosed subject matter or to delineate the scope of various embodiments disclosed herein. Its sole purpose is to present some concepts in a simplified form as a prelude to the more detailed description that is discussed later.

In one illustrative embodiment, a well test module is disclosed including a production manifold, a well test manifold, and a plurality of diverter valves, each having an input port coupled to a well inlet, a first output port coupled to the production manifold by a production loop, and a second output port coupled to the well test manifold. The well test module also includes a first flow meter having an input port coupled to a first end of the well test manifold and an output port coupled to the production manifold by a first well test flow line, and a second flow meter having an input port coupled to a second end of the well test manifold and an output port coupled to the production manifold by a second well test flow line.

An illustrative method disclosed herein includes controlling a first diverter valve having an input port coupled to a first well inlet, a first output port coupled to a production manifold by a production loop, and a second output port coupled to a well test manifold to provide flow from the first well inlet through the first output port to the production manifold. The method also includes controlling a second diverter valve having an input port coupled to a second well inlet, a first output port coupled to a production manifold by a production loop, and a second output port coupled to a well test manifold to provide flow from the first well inlet through the second output port to the well test manifold. The method further includes enabling one of a first flow meter having an input port coupled to a first end of the well test manifold and an output port coupled to the production manifold by a first well test flow line, and a second flow meter having an input port coupled to a second end of the well test manifold and an output port coupled to the production manifold by a second well test flow line to measure flow in the well test manifold.

BRIEF DESCRIPTION OF THE DRAWINGS

Certain aspects of the presently disclosed subject matter will be described with reference to the accompanying drawings, which are representative and schematic in nature and are not be considered to be limiting in any respect as it relates to the scope of the subject matter disclosed herein.

Figure 1:
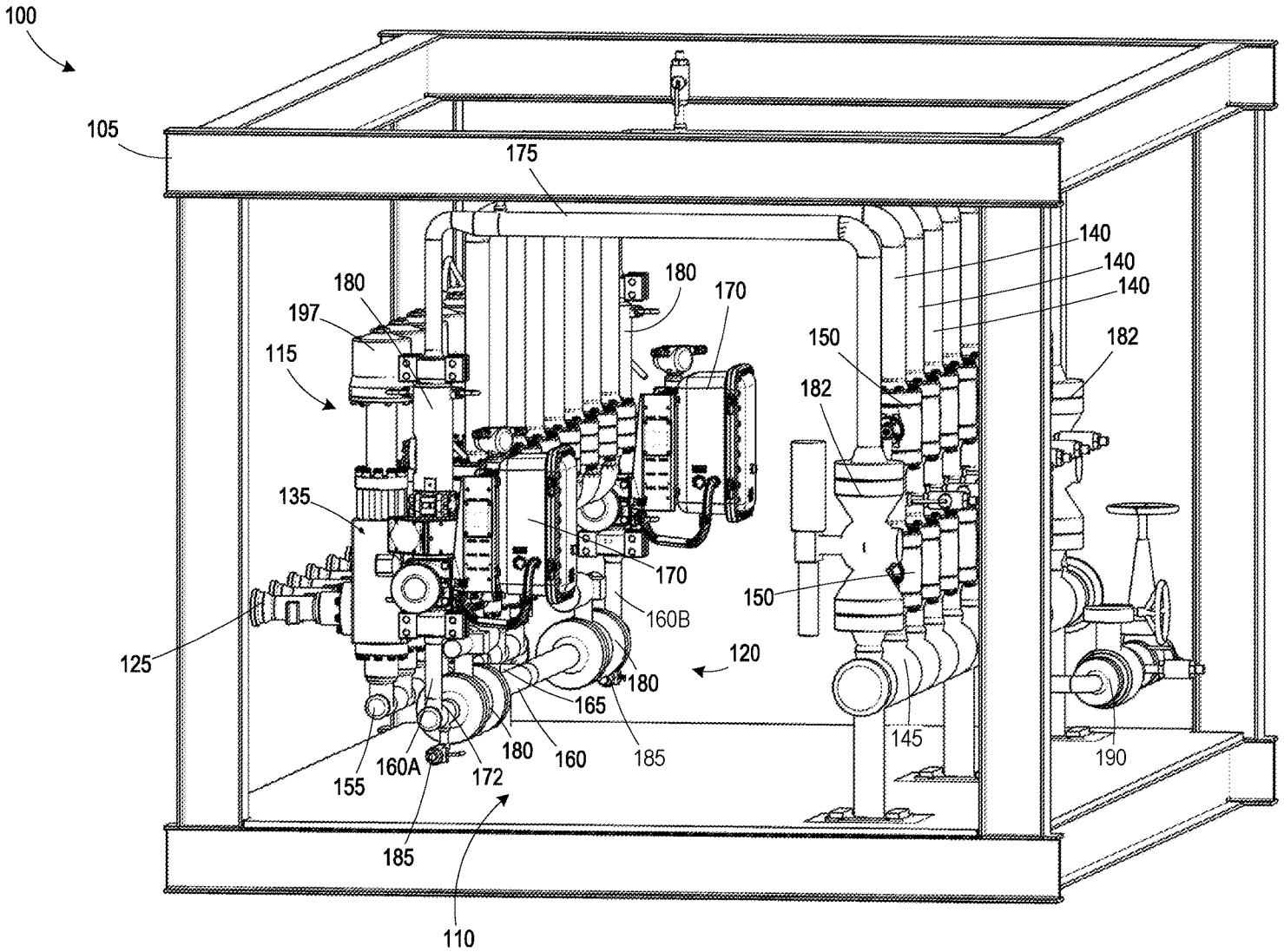
FIGS. 1-3 are perspective views of a well test module, according to some embodiments disclosed herein.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DESCRIPTION OF EMBODIMENTS

Various illustrative embodiments of the disclosed subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2:
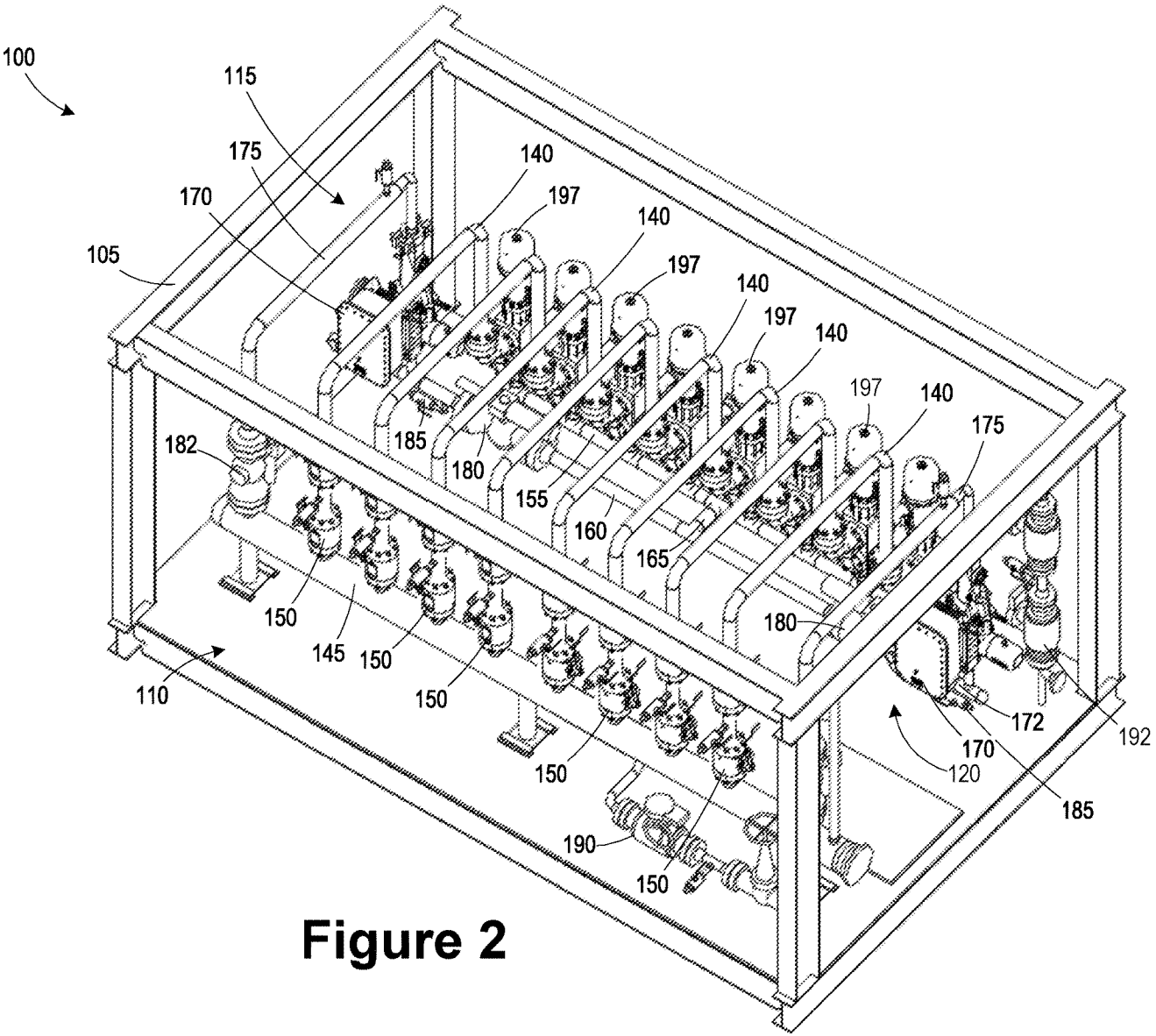
Figure 3:
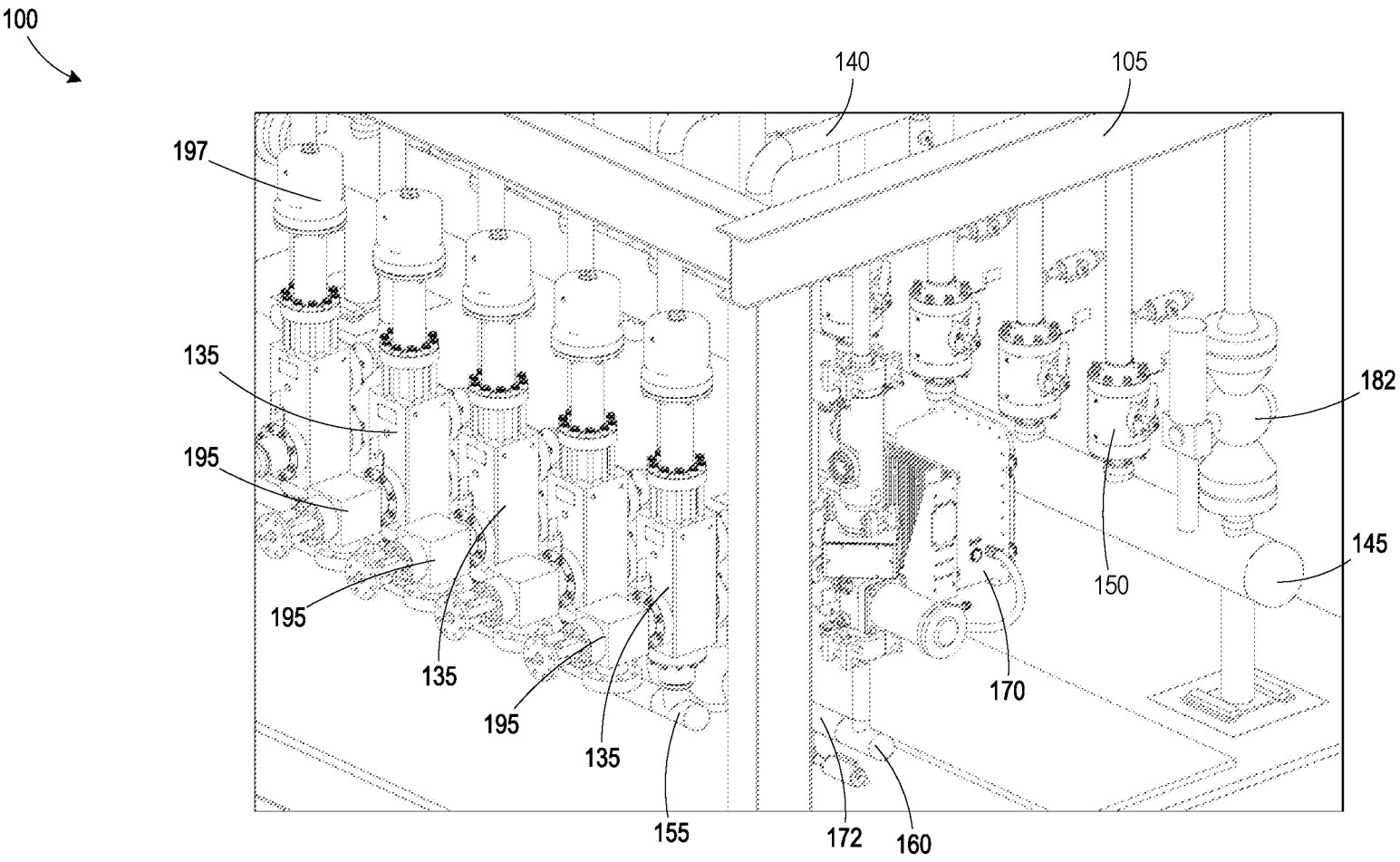

One illustrative example of a well test module 100 will be described with reference to the attached drawings. FIGS. 1-3 are perspective views of the well test module 100, according to some embodiments disclosed herein. In general, the well test module 100 facilitates well testing functionality from local or remote locations in a compact footprint. The well test module 100 includes a supporting frame 105 and a drip tray 110. The well test module 100 includes a production portion 115 and a test portion 120. The production portion 115 includes a plurality of well inlets 125. In some embodiments, the well test module 100 supports testing of eight wells, so eight well inlets 125 are provided. The well inlets 125 are connected to diverter valves 135. In some embodiments, the diverter valves 135 are single inlet, dual outlet diverter valves, such as valves offered by TechnipFMC PLC headquartered in London, UK. Example valve model numbers includes D2536, D2560, D3536, D3560, or D5060. In a first position, a given diverter valve 135 routes the flow from the associated well inlet 125 through a production loop 140 to a production manifold 145 with minimal pressure loss or induced turbulence, since both outlet paths of the diverter valve 135 is full bore. In some embodiments, isolation valves 150 are provided between the production loop 140 and the production manifold 145 for redundant isolation. In some embodiments, the isolation valves 150 are manually operated compact ball valves. In some embodiments, the production loops 140 are vertically-oriented, U-shaped loops extending from the diverter valves 135 to the production manifold 145. In some embodiments, sensors, such as pressure sensors or temperature sensors, are attached to the production loops 140.

The test portion 120 of the well test module 100 includes a production test collector 155 coupled to a well test manifold 160. One or more lines 165 connect the production test collector 155 to the well test manifold 160. Flow from the production test collector 155 is stabilized in the well test manifold 160. Multiphase flow meters 170 are coupled to respective ends of the well test manifold 160. In some embodiments, the multiphase flow meters 170 are combined multiphase and wet gas dual mode meters that switch automatically to the appropriate mode as dictated by the instantaneous gas volume fraction (GVF) of the fluid to provide accurate flow measurements. In some embodiments, the well test manifold 160 includes flow reduction spools 172 that accelerate the production flow prior to entering the multiphase flow meters 170. In some embodiments, sensors, such as pressure sensors or temperature sensors, are attached to the production manifold 145, the test collector 155 and the well test manifold 160.

Well test flow lines 175 couple the outputs of the multiphase flow meters 170 to the production manifold 145 to allow flow from the measured well to return to the production manifold 145 and combine with the outputs of the other wells within the boundaries of the frame 105. In some embodiments, sensors, such as pressure sensors or temperature sensors, are attached to the well test flow lines 175. Production control valves 180 are provided between the well test manifold 160 and the multiphase flow meters 170 and reintegration control valves 182 are provided between the well test flow lines 175 and the production manifold 145 to allow selection of a particular multiphase flow meter 170 to receive the flow from the well test manifold 160. In some embodiments, sample ports 185 are provided on the well test manifold 160. A drain valve assembly 190 and a sampling assembly 192 are provided on the production manifold 145. In some embodiments, the production control valves 180 are remote controlled valves. In a second position, a given diverter valve 135 routes the flow from the associated well inlet 125 to the production test collector 155. In some embodiments, the well test flow lines 175 are vertically-oriented, U-shaped loops extending from the well test manifold 160 to the production manifold 145.

In some embodiments, choke valves 195 are connected to the diverter valves 135, as illustrated in FIG. 3. In some embodiments, choke valves on the wellheads are controlled to adjust the relative pressures on the well inlets 125. In some embodiments, the diverter valves 135 include integrated choke valves. In some embodiments, the diverter valves 135 are two- or three-way valves that divert the flow from a given well inlet 125 to the well test manifold 160 and back to the production manifold 145. In some embodiments, an actuator 197, such as a pneumatic, hydraulic, or electrical actuator, allows remote operation of the diverter valves 135. Flow from the well inlets 125 is connected to a common port on the diverter valve 135. In some embodiments, the diverter valve 135 is normally open (N/O) and connects in the N/O positon to the production manifold 145. A second port of the diverter valve 135 is normally closed (N/C) and is connected to the production test collector 155.

The well test manifold 160 has two flow outlets 160A, 160B and sample ports 185, one at each end of the well test manifold 160. Flow from the well test manifold 160 is controlled by the production control valves 180 and the reintegration valves 182, and the flow outlets 160A, 160B are coupled to the multiphase flow meters 170. The positions of the production control valves 180 and the reintegration valves 182 are controlled to route the flow from the well test manifold 160 to one or both of the multiphase flow meters 170.

Figure 4:
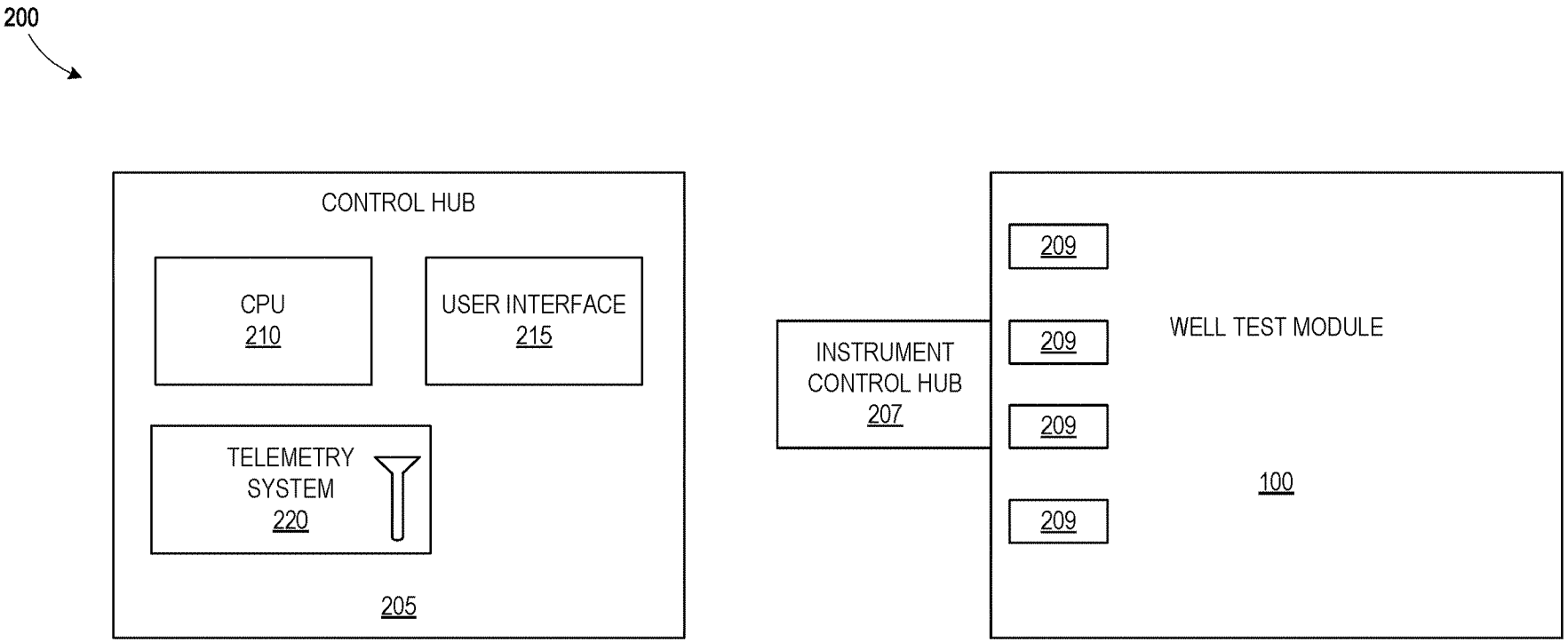
FIG. 4 is a block diagram of a system for controlling the well test module of FIG. 1, according to some embodiments disclosed herein.

FIG. 4 is a block diagram of a system 200 for controlling the well test module 100. The well test module 100 includes safety valves and sensors supporting safe system operation and allows local or remote control of well testing operations via a control hub 205. In some embodiments, the well test module 100 is located near a production field including multiple wells. In some embodiments, the wells are remote from the well test module 100. The control hub 205 provides an interface with an overall well control and production system. In some embodiments, the control hub 205 is self-contained and only requires power and utilities to operate within the rest of the production system. Connections between the control hub 205 and the main production control system can be via wireless, such as BLUETOOTH®, radio, Ethernet, Wi-Fi, or the like.

In some embodiments, an instrument control hub 207, including a central processing unit, is mounted locally on the frame 105. Field instruments 209, such as flow, temperature, and pressure sensors, provided on the well test module 100 are terminated to the instrument control hub 207. The instrument control hub 207 provides an interface for communicating with the control hub 205 or central control room. In some embodiments, the control hub 205 and the instrument control hub 207 are integrated into a single unit.

The control hub 205 is housed in a certified enclosure and includes a central processor unit 210 (CPU), a user interface 215, and a telemetry system 220, such as a wireless telemetry system. The CPU 210 runs system software to control the well test module 100. The CPU 210 is supplied with power from a redundant uninterruptible power supply system and is programed to run sequenced test cycles. In some embodiments, the control hub 205 includes a valve actuation system that includes fluid reservoirs, pumps, accumulators and directional valves configured to route hydraulic signals to the selected valves in the well test module 100. In some embodiments, the control hub 205 employs an electric configuration and includes control relays, contactors, and solid-state input/output (I/O) buses to control electric valve actuators and associated equipment in the well test module 100. In some embodiments, the control hub 205 employs a combination of hydraulic and electric control. The telemetry system 220 allows communication with the instrument control hub 207, the electrical or hydraulic actuator systems for controlling the well test module 100, and a remote customer control system.

When a field is in full production, the diverter valves 135 are configured in the N/O position to route the production flows from the well inlets 125 through the production loops 140 to the production manifold 145. A production operator or an automated test process selects a particular well to be tested and the control hub 205 initiates a test cycle. The production operator or automated test process selects one or both of the multiphase flow meters 170 to be used for the test cycle. The control hub 205 initiates valve control operations to open the production control valve 180 for the selected multiphase flow meter 170. The associated reintegration valve 182 is placed in standby mode. Once this operation is complete, the control hub 205 operates the diverter valve 135 associated with the selected well, which shifts the flow from the N/O port flowing to the production manifold 145 to the production test collector 155. The control hub 205 then opens the associated reintegration valve 182, which allows the product to flow through the well test collector 155, into the well test manifold 160, and through the selected multiphase meter 170 with minimal flow restriction. The control hub 205 controls choke functionality provided via one of a choke on the well, a choke valve 195 connected to the diverter valve 135, or a choke integrated into the diverter valve 135 to maintain the test flow and pressure to provide the required reintegration flow. Flow from the selected well can now be tested in accordance with the defined test program over any specified duration. Since the tested flow is returned into the production output, no losses occur. After the well has been successfully tested, the valves 135, 180, 182 are controlled to return them to their production positions to terminate the test and return the output of the tested well to the production header 145.

In some embodiments, the control hub 205 initiates in-place calibration routines for the multiphase flow meters 170. The multiphase flow meters 170 perform automatic self-configuration of water properties and are capable of updating gas and oil properties without the need for sampling. In some embodiments, the multiphase flow meters 170 are remotely self-calibrating, thereby negating the need to mobilize equipment and personnel to the site to perform calibration procedures. In some embodiments, self-calibration is performed by configuring each multiphase flow meter 170 to run a series of calibration sequences to ensure it is operating against its designed parameters for the produced fluid types. The principal methods employed are to set the "zero" point of a selected multiphase flow meter 170 where no flow is present at a known pressure and temperature, and to use a second multiphase flow meter 170 to compare the flowing results of the first multiphase flow meter 170 on test. The results are compared to the factory settings of the multiphase flow meter 170 for its specific application and product to be measured. The control hub 205 can perform calibrations in response to operator input or fully autonomously, such as at predetermined time intervals.

In a calibration cycle, the multiphase flow meter 170 being calibrated receives a signal to place it in ready mode. The selected multiphase flow meter 170 is the one that is not in use during the production cycle. If both multiphase flow meters 170 are being used in production, either can be selected for the test, with the other maintaining normal operation. The first test cycle is confirmed as zero point calibration. The control hub 205 controls the production control valves 180 on the well test manifold 160 to close slowly. The control hub 205 then closes the reintegration valve 182 between the outlet on the multiphase flow meter 170 and the production manifold 145, thereby isolating the multiphase flow meter 170 to be tested. Pressure and temperature sensors 209 on the well test flow line 175 verify the shut in pressure and the control hub 205 waits for the temperature to stabilize to the agreed test temperature. The control hub 205 polls the three measurement devices within the well test flow lines 175 and confirms zero flow. If any parameters are off, the control hub 205 resets the meter to the new zero point. Following the zero point calibration, the well test flow line 175 is placed into flow test mode, where the measured flow will be compared to the factory set operating parameters while the other multiphase flow meter 170 is operating. The production control valve 180 and the reintegration valve 182 slowly start to open in the reverse of the shutdown sequence. Once the multiphase flow meter 170 under test is operational, the control system compares the produced flow parameters with the current operating measurements from the multiphase flow meter 170 to check for parity and consistency. The results are also compared to the factory settings for the known product at the current temperature and pressures. If the comparisons are outside preset operating parameters, the control hub 205 runs a further test cycle to verify the results before making any adjustments to the multiphase flow meter 170 under test. In some embodiments, the control hub 205 alerts the manufacturer service manager to perform a manual check of the results and determine if further actions are necessary. If the multiphase flow meter 170 is determined to be significantly out of scale, a service ticket is generated and the operator/company is notified that field service may be required. After the multiphase flow meter 170 has been through a calibration cycle, the test and results are logged for future reference and the multiphase flow meter 170 returns to normal operation.

This operation and the entire sequence of well tests and meter calibrations can be controlled locally by the control hub 205 or from the customer's remote control room or station. The control hub 205 and well test module 100 can be programed to conduct, log and report the production well test program for the entire field by cycling through the wells. The control hub 205 can then transmit the results back to the production manager and reservoir engineers in real time, allowing the data to be analyzed in a timely manner to mitigate any potential reservoir issues that may be developing post flowback and clean up. In some embodiments, the set of well parameters and choke adjustments are preprogramed. In some embodiments, testing data and information from the multiphase flow meters 170 allow adjustments to be made for the choke parameters to optimize well operation.

The well test module 100 described herein has numerous advantages. The well test module 100 allows for the offshore or onshore testing of individual wells without the need for a test separator, complex pipework, or valving and eliminates the need for manned intervention to control and monitor the process of routine well tests. The well test module 100 enables selection of the well to be tested, re-routing of the flow from the selected well, and three-phase measurement of well output to be controlled remotely. The well test module 100 provides a compact, skid-mounted design with optional onboard choke valves, built-in pressure headers and sensors for regular production output, along with dual remote calibrating multi-phase meters, high pressure flow divert valving, and pipework. The well test module 100 fully integrates well control, control of choke settings, fluid directional control, multiphase metering, sampling, and production, all within a single module or skid. The well test module 100 supports full remote control, from an onsite or offsite location, and allows remote calibration of the flow meters 170 without breaking into the local pipework. The well test module 100 provides the operator the ability to test wells as frequently as desired with manual remote control or to run pre-programed test sequences to test each well at specific times over a day, week, or month. The well test module 100 eliminates the need to provide production testing service personnel at the well site or to make and test temporary connections to the wells in the field, therefore reducing risk to personnel and the environment.

The particular embodiments disclosed above are illustrative only, as the disclosed subject matter may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the claimed subject matter. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

The invention claimed is:

1. A well test module, comprising:

a production manifold;

a well test manifold;

a plurality of diverter valves, each having an input port coupled to a well inlet, a first output port coupled to the production manifold by a production loop, and a second output port coupled to the well test manifold;

a first flow meter having an input port coupled to a first end of the well test manifold and an output port coupled to the production manifold by a first well test flow line; and a second flow meter having an input port coupled to a second end of the well test manifold and an output port coupled to the production manifold by a second well test flow line.

2. The well test module of claim 1, wherein each production loop comprises a vertically-oriented piping loop.

3. The well test module of claim 1, wherein the first well test flow line and the second well test flow line each comprises a vertically-oriented piping loop.

4. The well test module of claim 1, wherein the production manifold is positioned parallel to the well test manifold.

5. The well test module of claim 1, further comprising:

a first control valve positioned between the well test manifold and the first flow meter; and a second control valve positioned between the well test manifold and the second flow meter.

6. The well test module of claim 5, further comprising:

a first reintegration valve positioned between the first well test flow line and the production manifold; and a second reintegration valve positioned between the second well test flow line and the production manifold.

7. The well test module of claim 1, further comprising:

a production test collector coupled to the second output ports of the plurality of diverter valves; and a line connecting the production test collector to the well test manifold.

8. The well test module of claim 7, wherein the production manifold is positioned parallel to the well test manifold, and the production test collector is positioned parallel to the well test manifold.

9. The well test module of claim 1, further comprising a frame supporting the production manifold and the well test manifold.

10. The well test module of claim 1, further comprising a control hub connected to actuators of the plurality of diverter valves.

11. A method, comprising:

controlling a first diverter valve having an input port coupled to a first well inlet, a first output port coupled to a production manifold by a production loop, and a second output port coupled to a well test manifold to provide flow from the first well inlet through the first output port to the production manifold;

controlling a second diverter valve having an input port coupled to a second well inlet, a first output port coupled to a production manifold by a production loop, and a second output port coupled to a well test manifold to provide flow from the first well inlet through the second output port to the well test manifold; and enabling one of a first flow meter having an input port coupled to a first end of the well test manifold and an output port coupled to the production manifold by a first well test flow line and a second flow meter having an input port coupled to a second end of the well test manifold and an output port coupled to the production manifold by a second well test flow line to measure flow in the well test manifold.

12. The method of claim 11, wherein each production loop comprises a vertically-oriented piping loop.

13. The method of claim 11, wherein the first well test flow line and the second well test flow line each comprises a vertically-oriented piping loop.

14. The method of claim 11, wherein the production manifold is positioned parallel to the well test manifold.

15. The method of claim 11, further comprising:

opening one of a first control valve positioned between the well test manifold and the first flow meter and a second control valve positioned between the well test manifold and the second flow meter.

16. The method of claim 15, further comprising:

opening one of a first reintegration valve positioned between the first well test flow line and the production manifold and a second reintegration valve positioned between the second well test flow line and the production manifold.

17. The method of claim 11, wherein a production test collector is coupled to the second output ports of the first and second diverter valves, a line connects the production test collector to the well test manifold, and the production manifold is positioned parallel to the well test manifold, and the production test collector is positioned parallel to the well test manifold.

18. The method of claim 11, further comprising:

calibrating the first flow meter using the second flow meter.

19. The method of claim 11, further comprising:

collecting data from the enabled one of the first flow meter or the second flow meter in a control hub; and transmitting the data to a remote entity.

20. The method of claim 19, further comprising:

receiving control commands from the remote entity to control the first diverter valve, control the second diverter valve, and enable the one of the first flow meter or the second flow meter.

* * * * *